US008574808B2

(12) United States Patent
Mizuhata et al.

(10) Patent No.: US 8,574,808 B2
(45) Date of Patent: Nov. 5, 2013

(54) RESIN EMULSION

(75) Inventors: Hiroshi Mizuhata, Wakayama (JP); Takashi Kubo, Wakayama (JP); Takashi Mukai, Wakayama (JP)

(73) Assignee: KAO Corporation, Tokyo (JP)

( * ) Notice: Subject to any disclaimer, the term of this patent is extended or adjusted under 35 U.S.C. 154(b) by 1358 days.

(21) Appl. No.: 11/774,284

(22) Filed: Jul. 6, 2007

(65) Prior Publication Data

US 2008/0026311 A1 Jan. 31, 2008

(30) Foreign Application Priority Data

Jul. 31, 2006 (JP) ..... 2006-208506

(51) Int. Cl.
*G03G 9/13* (2006.01)

(52) U.S. Cl.
USPC ..... 430/137.14; 430/109.4; 430/137.16

(58) Field of Classification Search
USPC ..... 430/109.4, 137.14, 137.16
See application file for complete search history.

(56) References Cited

U.S. PATENT DOCUMENTS

| | | | | |
|---|---|---|---|---|
| 6,653,435 | B1 * | 11/2003 | Aoki et al. | 528/296 |
| 7,473,511 | B2 * | 1/2009 | Matsumura et al. | 430/137.14 |
| 7,575,841 | B2 * | 8/2009 | Daimon et al. | 430/109.4 |
| 2002/0177636 | A1 | 11/2002 | Kawamura et al. | |
| 2004/0157986 | A1 | 8/2004 | Winter et al. | |
| 2004/0209182 | A1 * | 10/2004 | Kawase | 430/137.14 |
| 2005/0271965 | A1 * | 12/2005 | Kamiyoshi et al. | 430/111.4 |
| 2006/0084001 | A1 * | 4/2006 | Nakanishi et al. | 430/109.4 |
| 2006/0100332 | A1 | 5/2006 | Gertzmann et al. | |
| 2006/0105262 | A1 | 5/2006 | Sata et al. | |
| 2006/0115759 | A1 * | 6/2006 | Kim et al. | 430/109.4 |
| 2006/0263709 | A1 * | 11/2006 | Matsumura et al. | 430/105 |
| 2007/0020550 | A1 * | 1/2007 | Kamoto | 430/109.4 |
| 2007/0088119 | A1 * | 4/2007 | Kamiyoshi et al. | 524/599 |

FOREIGN PATENT DOCUMENTS

| | | |
|---|---|---|
| CN | 1746777 A | 3/2006 |
| JP | 5-295100 | 11/1993 |
| JP | 6-19204 | 1/1994 |
| JP | 9-31286 | 2/1997 |
| JP | 2002-351139 | 12/2002 |
| JP | 2002-356545 | 12/2002 |
| JP | 2003-122051 | 4/2003 |
| JP | 2004-529237 | 9/2004 |
| JP | 2006-171692 | 6/2006 |
| JP | 2006-183035 | 7/2006 |

OTHER PUBLICATIONS

U.S. Appl. No. 12/595,962, filed Oct. 15, 2009, Mizuhata, et al.
U.S. Appl. No. 12/525,834, filed Aug. 5, 2009, Mizuhata, et al.
Office Action issued Dec. 14, 2010, in China Patent Application No. 200710139782.7 (submitting full English translation only)..
Office Action issued Dec. 24, 2010, in China Patent Application No. 200710139782.7 (with English translation).
Office Action issued Nov. 22, 2011 in Japan Application No. 2007-165961 (With English Translation).
Office Action issued Nov. 1, 2011 in China Application No. 200710139782.7 (With English Translation).

* cited by examiner

*Primary Examiner* — Mark F Huff
*Assistant Examiner* — Rachel Zhang
(74) *Attorney, Agent, or Firm* — Oblon, Spivak, McClelland, Maier & Neustadt, L.L.P.

(57) ABSTRACT

The present invention relates to a resin emulsion being produced by neutralizing a resin binder containing acid group with a basic compound in an aqueous medium wherein the resin binder containing acid group contains a polyester produced from a raw monomer composition containing a trivalent or higher-valent polyhydric alcohol in an amount of 1 to 15 mol %; a process for producing the resin emulsion; and a toner for electrophotography using the resin emulsion. In the resin emulsion of the present invention, a resin is readily emulsified therein even when using a crosslinked polyester as the resin, and the resin emulsion is substantially free from hydrolysis of the resin and can produce a toner having an excellent heat-resistant storage property.

20 Claims, No Drawings

RESIN EMULSION

FIELD OF THE INVENTION

The present invention relates to a resin emulsion for use in electrophotography, electrostatic recording method, electrostatic printing method or the like, a toner for electrophotography which is produced from the resin emulsion, and processes of producing the resin emulsion and the toner.

BACKGROUND OF THE INVENTION

In the field of toners for electrophotography, it has been demanded to develop toners having a smaller particle size and an excellent fusing property in view of achieving higher image qualities. Conventional processes for producing the toners include a melt-kneading and pulverization method, and a wet process such as an emulsification and aggregation method. In these methods, resin binders, for example, those composed mainly of a polyester, are used to obtain toner particles.

Conventionally, upon producing a crosslinked polyester as the resin binder, a trivalent or higher valent polycarboxylic acid such as trimellitic acid has been used as a raw crosslinking component thereof. For example, JP 6-19204A discloses the toner using such a polyester produced from a monomer composition composed of an aromatic dicarboxylic acid component selected from isophthalic acid, terephthalic acid and derivatives thereof, an aromatic tricarboxylic acid component selected from trimellitic acid and derivatives thereof, a dicarboxylic acid component selected from dodecenylsuccinic acid, octylsuccinic acid and anhydrides thereof, and a propoxylated and/or ethoxylated etherified diphenol component.

SUMMARY OF THE INVENTION

Thus, the present invention relates to the following aspects (1) to (4):

(1) A resin emulsion being produced by neutralizing a resin binder containing acid group with a basic compound in an aqueous medium, wherein the resin binder containing acid group contains a polyester produced from a raw monomer composition containing a trivalent or higher-valent polyhydric alcohol in an amount of 1 to 15 mol %;

(2) a process for producing a resin emulsion, including the step of neutralizing wherein a resin binder containing acid group with a basic compound in an aqueous medium, wherein the resin binder containing acid group contains a polyester produced from a raw monomer composition containing a trivalent or higher-valent polyhydric alcohol in an amount of 1 to 15 mol %;

(3) a toner for electrophotography which is produced by aggregating and unifying emulsified resin particles contained in the resin emulsion as defined in the above aspect (1); and (4) a process for producing a toner for electrophotography, including the steps of:

(A) neutralizing a resin binder containing acid group containing a polyester produced from a raw monomer composition containing a trivalent or higher-valent polyhydric alcohol in an amount of 1 to 15 mol %, with a basic compound in an aqueous medium to obtain a resin emulsion; and (B) aggregating and unifying emulsified resin particles contained in the resin emulsion.

DETAILED DESCRIPTION OF THE INVENTION

When using a crosslinked polyester produced from the above trivalent or higher valent polycarboxylic acid such as trimellitic acid and derivatives thereof, it is difficult to produce an emulsion thereof by a phase inversion emulsification method. Even though any emulsion is produced from the crosslinked polyester, there tends to arise such a problem that resins contained in the emulsion suffer from hydrolysis owing to an alkali, resulting in considerable deterioration in thermal properties thereof.

The present invention relates to a resin emulsion in which a resin can be readily emulsified even when using a crosslinked polyester as the resin and which is substantially free from hydrolysis of the resin and can produce a toner having an excellent heat-resistant storage property; a process for producing the resin emulsion; a toner for electrophotography which is produced by using the resin emulsion and can exhibit an excellent heat-resistant storage property; and a process for producing the toner.

The resin emulsion and the process for producing the resin emulsion according to the present invention are described below.

[Resin Binder Containing Acid Group]

The resin binder containing acid group (hereinafter occasionally referred to merely as a "resin binder") is a resin usable as a binder in a toner. Examples of the resin binder containing acid group include known resins for toners such as polyesters, styrene-acryl copolymers, epoxy resins, polycarbonates and polyurethanes. Among these resins, preferred are polyesters and styrene-acryl copolymers, and more preferred are polyesters, from the viewpoints of a good dispersibility of colorants therein, a good fusing property and a good durability. The content of the polyester in the resin binder is preferably 60% by weight or larger, more preferably 70% by weight or larger, even more preferably 80% by weight or larger and further even more preferably 90% by weight or larger. In the present invention, these resins may be used as the resin binder alone or in combination of any two or more thereof.

The polyester contained in the resin binder containing acid group may be either a crystalline polyester or an amorphous polyester.

As the raw monomers of the polyester, there may be used a known divalent or higher-valent alcohol component and a known carboxylic acid component such as a divalent or higher-valent carboxylic acid, and anhydrides and esters of the carboxylic acid.

Specific examples of the alcohol component include aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol and 1,4-butenediol; aromatic diols such as alkyleneoxide adducts of bisphenol A represented by the formula (I):

(I)

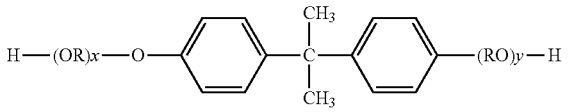

wherein RO is an alkyleneoxide; R is an alkylene group having 2 or 3 carbon atoms; and x and y respectively represent an average molar number of addition of alkylene oxides and are respectively a positive number with the proviso that a sum of x and y is from 1 to 16, preferably from 1 to 8 and more preferably from 1.5 to 5; and trivalent or higher valent polyhydric alcohols such as glycerol, pentaerythritol, trimethylol propane and sorbitol. These alcohol components may be used alone or in combination of any two or more thereof.

The polyester is produced by a polycondensation reaction between the above alcohol component and the below-mentioned carboxylic acid component as the raw monomers. In the present invention, from the viewpoints of a good fusing property, a good storage property, a good emulsifiability and a good hydrolysis resistance, the raw monomer composition contains the trivalent or higher-valent polyhydric alcohol in an amount of 1 to 15 mol % on the basis of the whole raw monomers. In general, the crosslinked polyester which is produced from a trivalent or higher-valent polycarboxylic acid such as trimellitic acid or derivatives thereof tends to be insufficiently neutralized upon emulsification thereof, resulting in occurrence of undesirable hydrolysis of the polyester. The reason for the insufficient neutralization is considered to be that an acid group of the crosslinked polyester is present in the vicinity of a rigid crosslinking point of the polyester. On the contrary, when using the trivalent or higher-valent polyhydric alcohol as a crosslinking component as described in the present invention, the acid group of the polyester is more likely to be present not in the vicinity of a crosslinking center thereof but at a terminal end of a main chain thereof. Therefore, it is considered that the polyester tends to be more efficiently neutralized with a basic compound, resulting in facilitated production of the resin emulsion. Thus, in the present invention, it is suggested that since the basic compound is effectively used for neutralization of the polyester, the hydrolysis of the polyester owing to the basic compound can be inhibited.

The trivalent or higher-valent polyhydric alcohols usable in the present invention are preferably trivalent to hexavalent aliphatic polyhydric alcohols in view of effectively neutralizing the polyester and preventing the polyester from being hydrolyzed. Among these aliphatic polyhydric alcohols, more preferred are glycerol, pentaerythritol, trimethylol propane and sorbitol, and still more preferred is glycerol. These aliphatic polyhydric alcohols may be used alone or in combination of any two or more thereof. Meanwhile, in the present invention, the aliphatic polyhydric alcohols may include an alicyclic polyhydric alcohol such as, for example, 1,4-sorbitan.

The trivalent or higher-valent polyhydric alcohol is contained in the raw monomer composition containing the alcohol component and the acid component in an amount of 1 to 15 mol % on the basis of the whole raw monomers. When the content of the trivalent or higher-valent polyhydric alcohol in the raw monomer composition is 1 mol % or higher, the effect by the addition of the polyhydric alcohol can be sufficiently exhibited, so that the crosslinked resin obtained therefrom can has a desired softening point and a high molecular weight. When the content of the trivalent or higher valent polyhydric alcohol in the raw monomer composition is 15 mol % or lower, the polyester can be prevented from suffering from too high crosslinking density and occurrence of hydrolysis of the resin upon the neutralization step, and occurrence of incomplete emulsification of the polyester owing to the insufficient neutralization. Form the above viewpoints, the content of the trivalent or higher-valent polyhydric alcohol in the raw monomer composition is preferably from 1.5 to 14 mol %, more preferably from 1.5 to 13 mol % and even more preferably from 1.5 to 10 mol % on the basis of the whole raw monomers.

When the above polyester is an amorphous polyester, the alcohol component used for production of the amorphous polyester preferably contains, in addition to the above trivalent or higher-valent polyhydric alcohol, the alkyleneoxide adducts of bisphenol A represented by the above formula (I), e.g., the alkylene ($C_2$ to $C_3$) oxide adducts of bisphenol A (average molar number of addition of alkyleneoxides: 1 to 16) such as polyoxypropylene-2,2-bis(4-hydroxyphenyl)propane and polyoxyethylene-2,2-bis(4-hydroxyphenyl)propane.

Examples of the carboxylic acid component include aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecyl succinic acid and n-dodecenyl succinic acid; alicyclic dicarboxylic acids such as cyclohexanedicarboxylic acid; aromatic dicarboxylic acids such as phthalic acid, isophthalic acid and terephthalic acid; trivalent or higher-valent polycarboxylic acids such as trimellitic acid and pyromellitic acid; and anhydrides and alkyl ($C_1$ to $C_3$) esters of these acids. These carboxylic acid components may be used alone or in combination of any two or more thereof.

The polyester may be produced, for example, by polycondensing the alcohol component and the carboxylic acid component in an inert gas atmosphere at a temperature of 180 to 250° C., if required, by using a known esterification catalyst.

The above polyesters may be used alone or in combination of any two or more thereof as the resin binder.

The polyester used in the present invention has a softening point of preferably from 80 to 165° C. and more preferably from 95 to 160° C., and a glass transition point of preferably from 50 to 85° C. and more preferably from 50 to 75° C. in view of a good storage property of the resultant toner. Also, in order to stabilize emulsified particles and obtain a toner having a small particle size and a narrow particle size distribution, the polyester has an acid value of preferably from 6 to 30 mg KOH/g, more preferably from 6.5 to 29 mg KOH/g and even more preferably from 7 to 28 mg KOH/g, and a hydroxyl value of preferably from 3 to 60 mg KOH/g. In the present invention, there is preferably used such a polyester satisfying at least one of the above properties. Meanwhile, the desired softening point and acid value of the polyester can be achieved by controlling conditions of the polycondensation reaction such as temperature and time, composition of the raw monomers, etc.

The weight-average molecular weight of the polyester is preferably from 5,000 to 150,000 and more preferably from 10,000 to 120,000, and the number-average molecular weight of the polyester is preferably from 1,000 to 100,000, more preferably from 1,000 to 50,000 and even more preferably from 1,000 to 12,000 from the viewpoints of a good durability and a good fusing property.

The resin binder used in the present invention contains an acid group. In particular, the acid group is preferably bonded to a terminal end of a molecular chain of the resin binder containing acid group. Examples of the acid group include a carboxyl group, a sulfonic group, a phosphonic group and a sulfinic group. Among these acid groups, from the viewpoint of satisfying both a good emulsifiability of the resin and a good environmental resistance of the resultant toner, preferred is a carboxyl group. The amount of the acid group bonded to a terminal end of a molecular chain of the resin binder containing acid group is one of important factors for attaining a good stability of emulsified particles and determining a particle size distribution and a particle size of the resultant toner. The resin binder has an acid value of preferably from 6 to 30 mg KOH/g, more preferably from 6.5 to 29 mg KOH/g and even more preferably from 7 to 28 mg KOH/g in order to stabilize the emulsified particles and obtain a toner having a small particle size and a narrow particle size distribution.

Also, from the viewpoint of rapidly and uniformly dispersing the resin particles, as the resin binder containing acid group, there are preferably used resin particles having such a particle size in which 95% by weight or more and preferably 98% by weight or more of the particles are capable of passing through a sieve having an opening diameter of 5.6 mm. The resin particles having such a particle size can be uniformly dispersed and can be evenly neutralized in the next neutralizing step, thereby enabling preparation of homogeneously emulsified particles.

From the same viewpoints as described above for the polyester, the resin binder preferably has a softening point of 80 to 165° C. and a glass transition point of 50 to 85° C. The weight-average molecular weight and number-average molecular weight of the resin binder are preferably similar to those of the above polyester. Meanwhile, when the resin binder is composed of a plurality of resins, the average molecular weights, softening point, glass transition point and acid value of the resin binder all mean those values of a mixture of these resins.

[Resin Emulsion and Process for Producing Resin Emulsion]

The resin emulsion of the present invention is produced by neutralizing the resin binder containing acid group with a basic compound in an aqueous medium.

The aqueous medium contains water as a main component. From the viewpoint of environmental protection, the water content in the aqueous medium is preferably 80% by weight or more, more preferably 90% by weight or more and even more preferably 100% by weight. In the present invention, the resin binder may be dispersed in water solely without using substantially any organic solvent. Examples of components other than water which can be contained in the aqueous medium include water-soluble organic solvents such as methanol, ethanol, isopropanol, butanol, acetone, methyl ethyl ketone and tetrahydrofuran. Among these organic solvents, from the viewpoint of less inclusion into the toner, preferred are alcohol-based organic solvents incapable of dissolving resins therein such as methanol, ethanol, isopropanol and butanol.

The basic compound may be either an inorganic basic compound or an organic basic compound. Examples of the inorganic basic compound include alkali metal hydroxides such as sodium hydroxide, potassium hydroxide and lithium hydroxide, weak acid salts of these alkali metal hydroxides such as carbonates and acetates or partially neutralized salts thereof, and ammonia. Examples of the organic basic compound include alkyl amines such as methylamine, dimethylamine, trimethylamine, ethylamine, diethylamine and triethylamine; alkanol amines such as diethanol amine; fatty acid salts such as sodium succinate and sodium stearate. These basic compounds may be used alone or in combination of any two or more thereof.

The basic compound may be used in the form of a basic aqueous medium. The content of the basic compound in the basic aqueous medium may vary depending upon kind of the basic compound used, and is usually from 1 to 30% by weight, preferably from 3 to 20% by weight and more preferably from 5 to 10% by weight from the viewpoint of preventing hydrolysis of the resin binder. The aqueous medium used in the basic aqueous medium may be the same as described above.

The basic aqueous medium may be used in an amount of preferably from 5 to 100 parts by weight, more preferably from 10 to 90 parts by weight and even more preferably from 20 to 80 parts by weight on the basis of 100 parts by weight of the resin binder containing acid group from the viewpoint of efficiently producing a uniform resin emulsion.

The resin emulsion of the present invention may be produced by dispersing the resin binder containing acid group in the aqueous medium, neutralizing the resultant dispersion at a temperature not higher than a softening point of the resin, and then adding an aqueous liquid to the thus neutralized dispersion to emulsify the resin in the aqueous medium.

In the present invention, a surfactant may be added upon the above dispersing treatment. The amount of the surfactant added is preferably 5% by weight or smaller, more preferably from 0.2 to 5% by weight, even more preferably from 0.5 to 4% by weight and further even more preferably from 1 to 3% by weight on the basis of the weight of the resin from the viewpoint of preventing foaming upon the dispersing step and for the purpose of enhancing an emulsification stability of the finally obtained resin emulsion.

Examples of the surfactant include anionic surfactants such as sodium dodecylbenzenesulfonate, sodium octadecylsulfate, sodium oleate, sodium laurate and potassium stearate; cationic surfactants such as laurylamine acetate, stearylamine acetate and lauryl trimethyl ammonium chloride; amphoteric surfactants such as lauryl dimethylamine oxide; and nonionic surfactants such as polyoxyethylene alkyl ethers, polyoxyethylene alkylphenyl ethers, sorbitan monostearate and polyoxyethylene alkylamines. Among these surfactants, from the viewpoints of a good emulsification stability, etc., preferred are anionic surfactants and nonionic surfactants, and more preferred are anionic surfactants. These surfactants may be used alone or in combination of any two or more thereof.

In addition, the colorant together with other optional additives such as a releasing agent and a charge control agent may be added to the resin binder, and the resulting mixture may be supplied to dispersing treatment.

The colorant is not particularly limited, and may be appropriately selected from known colorants. Specific examples of the colorant include various pigments such as carbon blacks, inorganic composite oxides, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, Ultramarine Blue, Calco Oil Blue, Methylene Blue Chloride, Phthalocyanine Blue, Phthalocyanine Green and Malachite Green Oxalate; and various dyes such as acridine dyes, xanthene dyes, azo dyes, benzoquinone dyes, azine dyes, anthraquinone dyes, indigo dyes, thioindigo dyes, phthalocyanine dyes, Aniline Black dyes and thiazole dyes. These colorants may be used alone or in combination of any two or more thereof.

The weight ratio of the resin binder to the colorant is preferably from 70:30 to 97:3 and more preferably from 80:20 to 97:3 from the viewpoints of a good chargeability, a good durability and a high optical density of the resulting toner.

Specific examples of the releasing agent include low-molecular weight polyolefins such as polyethylene, polypropylene and polybutene; silicones exhibiting a softening point upon heating; fatty amides such as oleamide, erucamide, ricinolamide and stearamide; vegetable waxes such as carnauba wax, rice wax, candelilla wax, haze wax and jojoba oil; animal waxes such as beeswax; mineral and petroleum waxes such as montan wax, ozokerite, ceresin, paraffin wax, microcrystalline wax and Fischer-Tropsch wax; and the like.

The amount of the releasing agent formulated is usually from about 1 to about 20 parts by weight and preferably from 2 to 15 parts by weight on the basis of 100 parts by weight of a sum of the resin binder and the colorant in view of the effects due to addition thereof and the adverse influence on the chargeability.

Examples of the charge control agent include metal salts of benzoic acid, metal salts of salicylic acid, metal salts of alkyl salicylic acid, metal salts of catechol, metal-containing bisazo dyes, tetraphenyl borate derivatives, quaternary ammonium salts and alkyl pyridinium salts. These charge control agents may be used alone or in combination of any two or more thereof.

The amount of the charge control agent formulated is usually 10 parts by weight or less and preferably from 0.01 to 5 parts by weight on the basis of 100 parts by weight of a sum of the resin binder and the colorant.

From the viewpoints of uniformly dispersing the resin particles or a mixture of the resin particles and various additives, the above dispersing treatment is suitably conducted at a temperature lower than a softening point of the resin particles. When the resin particles or the mixture is dispersed at a temperature lower than the softening point of the resin particles and preferably at such a temperature which is not higher than the temperature lower by 50° C. than the softening point of the resin particles (hereinafter referred to as the "softening point of the resin binder−(minus) 50° C."), the resin particles can be prevented from being fused together, thereby preparing a uniform resin dispersion. Also, the lower limit of the temperature used upon the dispersing treatment is preferably higher than 0° C. and more preferably 10° C. or higher from the viewpoints of a good flowability of the medium and saving of energy for production of the resin emulsion. When the resin binder is in the form of a mixture of resins, a softening point of the mixed resin which is prepared by mixing the respective resins at a predetermined mixing ratio and melting the resulting mixture is regarded as the softening point of the resin binder. In addition, when the resin binder is in the form of a master batch, a softening point of a mixed resin composed of respective resins constituting the master batch is regarded as the softening point of the resin binder.

More specifically, particles of the resin binder containing acid group such as polyesters are stirred and dispersed together with a colorant, etc., in the basic aqueous medium containing a surfactant at a temperature lower than the softening point of the resin particles, for example, at a temperature of about 10 to 50° C., thereby preparing a uniform resin dispersion.

In the present invention, the resin dispersion thus prepared is neutralized with the above basic compound. The neutralization is conducted by stirring the resin dispersion together with the basic compound preferably at a temperature not higher than the softening point of the resin and more preferably at a temperature not higher than the softening point but not lower than the glass transition point of the resin for a predetermined period of time. From the viewpoint of uniformly neutralizing the resin, the time required for stirring the resin dispersion is preferably 30 min or longer and more preferably one hour or longer.

When the neutralization temperature is controlled to the above-specified range, the resin can be neutralized to a sufficient extent, so that formation of too large emulsified particles in the next emulsifying treatment is effectively inhibited, and further the heating treatment for the neutralization can be conducted without a special apparatus. From these viewpoints, the neutralization temperature is preferably not lower than the temperature calculated from the "glass transition point of the resin+(plus) 10° C." and not higher than the temperature calculated from the "softening point of the resin−(minus) 5° C.".

Further, from the viewpoint of suppressing hydrolysis of the resin, the neutralization is preferably conducted under near normal pressure, more specifically under a pressure of 80 to 300 kPa and more preferably 100 to 200 kPa.

In the neutralizing step, the resin is not necessarily neutralized entirely (100%) and may be neutralized to such an extent as to impart thereto a hydrophilicity required for producing the emulsified particles in the next step. For example, when using a high-hydrophilic resin containing a large number of polar groups, the degree of neutralization of such a resin may be low, whereas when using a low-hydrophilic resin, the degree of neutralization of the resin is preferably high. In the present invention, the degree of neutralization of the resin is preferably 50% or higher, more preferably from 60 to 100% and even more preferably from 70 to 100%. The degree of neutralization is generally expressed by a ratio between numbers of moles of the acid group before and after the neutralization (number of moles of acid group after neutralization/number of moles of acid group before neutralization).

More specifically, the resin dispersion is heated while stirring to a temperature not higher than the softening point of the resin and preferably a temperature not lower than the glass transition point of the resin, for example, to a temperature of about 90 to 100° C. when using a carboxyl-containing polyester having a glass transition point of about 60 to 65° C. and a softening point of about 110 to 120° C., and then held at such a temperature for an adequate period of time until reaching a desired degree of neutralization.

Then, an aqueous liquid is added to the thus neutralized dispersion at a temperature not lower than the glass transition point of the resin and not higher than the softening point thereof to emulsify the resin in the aqueous medium.

In the emulsifying step, from the viewpoint of preparing an emulsion containing fine resin particles, it is preferred that the neutralized resin dispersion is held at a temperature not lower than the glass transition point of the resin and not higher than the softening point thereof, and while stirring the dispersion, the aqueous liquid is added thereto to emulsify the resin in the aqueous medium.

When the emulsifying step is conducted in the above-specified temperature range, the resin can be smoothly emulsified in the aqueous medium, and the emulsifying treatment can be performed without using a special apparatus. From these viewpoints, the temperature used upon the emulsifying treatment is preferably not lower than the temperature calculated from the "glass transition point of the resin+(plus) 10° C." and not higher than the temperature calculated from the "softening point of the resin−(minus) 5° C.".

In the emulsifying step, from the viewpoints of facilitated phase inversion, etc., the content of the resin in the dispersion immediately before initiation of the emulsification is preferably from about 50 to about 90% by weight and more preferably from 50 to 80% by weight. Here, the wording "immediately before initiation of the emulsification" means the time at which a viscosity of the system becomes highest during the entire steps. Therefore, the time immediately before initiation of the emulsification may be readily determined, for example, by a torque meter fitted to a stirrer.

The emulsification initiation time may be optionally adjusted by controlling an acid value and a degree of neutralization of the resin used. For example, since such a resin having a high acid value or a high degree of neutralization exhibits a high hydrophilicity, the emulsification thereof can be initiated only by contacting with a small amount of the aqueous medium.

The aqueous liquid used for the emulsification may be the same as those illustrated above as the aqueous medium. The velocity of addition of the aqueous liquid is preferably from 0.5 to 50 g/min, more preferably from 0.5 to 30 g/min and still more preferably from 1 to 20 g/min per 100 g of the resin from the viewpoint of effectively conducting the emulsification. The velocity of addition of the aqueous liquid may be usually maintained until an O/W type emulsion is substantially formed. Therefore, the velocity of addition of the aqueous liquid after forming the O/W type emulsion is not particularly limited.

The solid content of the thus prepared resin emulsion is preferably from 7 to 50% by weight, more preferably from 7 to 45% by weight and still more preferably from 10 to 40% by weight from the viewpoints of a good stability of the resultant emulsion and a good handling property of the resin emulsion in the subsequent aggregating step.

The volume-median particle size ($D_{50}$) of the emulsified particles obtained after forming the O/W type emulsion is preferably from 0.02 to 2 μm, more preferably from 0.05 to 1 μm and even more preferably from 0.05 to 0.6 μm for the purpose of uniform aggregation thereof in the subsequent aggregating step. As to the particle size distribution of the emulsified particles, from the same viewpoints, the CV value [standard deviation of particle size distribution/volume-median particle size ($D_{50}$)×100] of the emulsified particles is preferably 60 or less and more preferably 45 or less. Meanwhile, the volume-median particle size ($D_{50}$) used herein means a particle size at which a cumulative volume frequency calculated on the basis of a volume fraction of particles from a smaller particle size side thereof is 50%.

The weight-average molecular weight of the resin contained in the emulsified resin particles is preferably from 5,000 to 150,000 and more preferably from 10,000 to 120,000 from the viewpoints of good hydrolysis resistance, durability and fusing property.

The present invention also relates to a process for producing the resin emulsion which includes the step of neutralizing a resin binder containing acid group with a basic compound in an aqueous medium, wherein the resin binder containing acid group contains a polyester produced from a raw monomer composition containing a trivalent or higher-valent polyhydric alcohol in an amount of 1 to 15 mol %. The aqueous medium, the resin binder containing acid group, the neutralizing step, etc., employed in the above production process, are the same as those described for the above resin emulsion.

In the resin emulsion of the present invention, even when using a crosslinked polyester, the resin is readily emulsified therein, and is substantially free from hydrolysis, and further a toner for electrophotography which exhibits an excellent heat-resistant storage property can be produced therefrom.

In the followings, the toner for electrophotography and the process for producing the toner are described.

[Toner for Electrophotography and Process for Producing the Toner]

Next, the emulsified particles contained in the thus prepared resin emulsion are aggregated (hereinafter referred to as the "aggregating step") and then unified (hereinafter referred to as the "unifying step"), thereby producing the toner for electrophotography according to the present invention. The above aggregating and unifying steps may be respectively conducted in the presence of a colorant. The colorant may be contained in the resin emulsion, or a dispersion of the colorant may be mixed with the resin emulsion to aggregate and unify the particles contained therein.

The pH of the system in the aggregating step is preferably from 2 to 10, more preferably from 2 to 9 and still more preferably from 3 to 8 from the viewpoint of satisfying both a good dispersion stability of the mixed liquid and a good aggregating property of fine particles of the resin binder, the colorant, etc.

From the same viewpoints, the temperature of the system in the aggregating step is preferably not lower than the temperature calculated from the "softening point of the resin binder−(minus) 50° C." and not higher than the temperature calculated from the "softening point of the resin binder−(minus) 10° C."; and more preferably not lower than the temperature calculated from the "softening point of the resin binder−(minus) 30° C." and not higher than the temperature calculated from the "softening point of the resin binder−(minus) 10° C.".

In the aggregating step, in order to effectively carry out the aggregation, an aggregating agent is preferably added to the resin emulsion. Examples of the aggregating agent include, in addition to the above surfactants, inorganic metal salts, divalent or higher-valent metal complexes and ammonium salts. The inorganic metal salts include, for example, metal salts such as sodium sulfate, calcium chloride, calcium nitrate, barium chloride, magnesium chloride, zinc chloride, aluminum chloride and aluminum sulfate; and inorganic metal salt polymers such as poly(aluminum chloride) and poly(aluminum hydroxide). Examples of the ammonium salts include quaternary ammonium salts such as tetraalkyl ammonium halides, as well as ammonium halides, ammonium sulfate, ammonium acetate, ammonium benzoate and ammonium salicylate. Among them, preferred are aluminum salts and their polymers, and ammonium salts. In particular, the ammonium salts are more preferred from the viewpoint of well-controlled shape of the toner particles, and trivalent aluminum salts and their polymers are also more preferred because they have a high aggregation capability even when used in a small amount, and can be simply produced. These aggregating agents may be used alone or in combination of any two or more thereof.

The amount of the aggregating agent used is preferably 30 parts by weight or less, more preferably from 0.01 to 20 parts by weight and even more preferably from 0.1 to 10 parts by weight on the basis of 100 parts by weight of the resin binder from the viewpoints of a good aggregating property and a good environmental resistance of the resulting toner.

The aggregating agent is preferably added in the form of an aqueous solution prepared by dissolving the aggregating agent in an aqueous medium. The mixture obtained during and after addition of the aggregating agent is preferably stirred to a sufficient extent. The thus obtained aggregated particles are then subjected to the step for unifying the aggregated particles (unifying step).

In the present invention, after aggregating the emulsified resin particles, a surfactant is preferably added thereto. More preferably, the surfactant added is at least one compound selected from the group consisting of alkylethersulfuric acid salts, alkylsulfuric acid salts and linear alkylbenzenesulfonic acid salts.

The alkylethersulfuric acid salts are preferably compounds represented by the following formula (1):

$$R^1—O—(CH_2CH_2O)_pSO_3M^1 \quad (1)$$

In the above formula (1), $R^1$ represents an alkyl group. From the viewpoints of a good adsorption to the aggregated particles and controlling a residual amount thereof on the toner, the alkyl group as $R^1$ preferably has 6 to 20 carbon atoms and more preferably 8 to 15 carbon atoms. The suffix p represents an average molar number of addition of from 0 to 15, and is preferably a number of from 1 to 10 and more preferably a number of from 1 to 5 from the viewpoint of well-controlled particle size of the resultant toner. $M^1$ represents a monovalent cation, and is preferably sodium, potassium or ammonium and more preferably sodium or ammonium from the viewpoint of well-controlled particle size of the resultant toner.

The linear alkylbenzenesulfonic acid salts are not particularly limited. From the viewpoints of a good adsorption to the aggregated particles and controlling a residual amount thereof on the toner, the linear alkylbenzenesulfonic acid salts are preferably compounds represented by the following formula (2):

$$R^2\text{-Ph-}SO_3M^2 \quad (2)$$

In the above formula (2), $R^2$ represents a linear alkyl group. Examples of the linear alkyl group as $R^2$ are the same as those which are linear among the alkyl groups exemplified as $R^1$ in the formula (1) Ph represents a phenyl group. $M^2$ represents a monovalent cation. Among these linear alkylbenzenesulfonic acid salts, preferred are sodium sulfate salts.

The amount of the surfactant added is preferably from 0.1 to 15 parts by weight, more preferably from 0.1 to 10 parts by weight and even more preferably from 0.1 to 8 parts by weight on the basis of 100 parts by weight of the resin constituting the aggregated particles from the viewpoints of a good aggregation stopping property and controlling a residual amount of the surfactant on the toner.

In the present invention, from the viewpoint of a high image quality, the volume median particle size ($D_{50}$) of the aggregated particles is preferably from 1 to 10 μm, more preferably from 2 to 10 μm and even more preferably from 2 to 9 μm.

In the present invention, from the viewpoints of preventing the releasing agent, etc., from being flowed out from the aggregated particles, enhancing a durability or a heat-resistant storage property, and maintaining charge amounts of the respective colors in a color toner at the same level, upon the aggregating step, other resin particles may be added either at one time or sequentially in plural divided parts to the resin particles contained in the resin emulsion of the present invention (hereinafter occasionally referred to merely as the "resin particles of the present invention"); or the resin particles of the present invention may be added either at one time or sequentially in plural divided parts to aggregated particles obtained by adding an aggregating agent to the other resin particles, in order to further aggregate these resin particles together.

The other resin particles are not particularly limited, and may be produced by the same method as used for production of the resin particles of the present invention.

The other resin particles may also contain, in addition to the resin binder, optional additives such as the above colorant, releasing agent and charge control agent as well as a surfactant, a fusing ability modifying agent, etc., according to the requirements.

The other resin particles used in the present invention may be the same as or different from the resin particles of the present invention. However, from the viewpoint of achieving both a good low-temperature fusing property and a good storage property of the toner, the resin particles of the present invention are preferably added either at one time or sequentially in plural divided parts to the aggregated particles obtained by adding an aggregating agent to other resin particles which are different from the resin particles of the present invention.

Also, the resin particles of the present invention may be mixed with the aggregated particles obtained by adding an aggregating agent to the other resin particles.

In the present invention, the time of adding the resin particles of the present invention is not particularly limited. From the viewpoint of a good productivity, the resin particles of the present invention are preferably added at any time between termination of adding the aggregating agent to the other resin particles and initiation of the unifying step.

The blending weight ratio of the resin particles of the present invention to the other resin particles (resin particles of the present invention/other resin particles) is preferably from 0.1 to 2.0, more preferably from 0.2 to 1.5 and even more preferably from 0.3 to 1.0 from the viewpoint of satisfying both a good low-temperature fusing property and a good heat-resistant storage property of the resultant toner.

The temperature of the reaction system in the unifying step is preferably equal to or higher than the temperature of the reaction system in the aggregating step. The temperature used in the unifying step is preferably not lower than the temperature calculated from the "softening point of the resin binder−(minus) 50° C." and not higher than the temperature calculated from the "softening point of the resin binder+(plus) 10° C."; more preferably not lower than the temperature calculated from the "softening point of the resin binder−(minus) 40° C." and not higher than the temperature calculated from the "softening point of the resin binder+(plus) 10° C."; and even more preferably not lower than the temperature calculated from the "softening point of the resin binder−(minus) 30° C." and not higher than the temperature calculated from the "softening point of the resin binder+(plus) 10° C." from the viewpoint of controlling particle size, particle size distribution and shape of the toner as desired, and fusibility of the aggregate particles. In addition, the stirring rate is preferably a rate at which the aggregate particles are not precipitated.

The unifying step can be carried out simultaneously with the aggregating step, for example, by continuously raising the temperature of the reaction system, or by heating the reaction system to a temperature at which the particles can be both aggregated and unified, and then continuously stirring the particles at the same temperature.

The resultant unified particles may be appropriately subjected, if required, to a liquid-solid separation step such as filtration, a washing step, a drying step, etc., whereby toner mother particles can be obtained.

In the washing step, it is preferable that an acid is used for removing metal ions from the surface of the respective toner mother particles in order to ensure sufficient chargeability and reliability of the resultant toner. The washing is preferably carried out plural times.

In addition, in the drying step, any optional methods such as vibration-type fluidizing drying method, spray-drying method, freeze-drying method and flash jet method can be employed. The water content after drying the toner mother particles is preferably adjusted to 1.5% by weight or less and more preferably 1.0% by weight or less from the viewpoint of a good chargeability of the resulting toner.

The toner for electrophotography according to the present invention contains the thus obtained unified particles (toner mother particles). The content of the unified particles in the toner is preferably from 95 to 100% by weight and more preferably from 96.5 to 99% by weight from the viewpoints of a good chargeability and a good fusing ability of the toner.

The volume median particle size ($D_{50}$) of the toner particles is preferably from 1 to 10 μm, more preferably from 2 to 8 μm and even more preferably from 3 to 7 μm from the viewpoints of high image quality and productivity. From the same viewpoints, as to the particle size distribution of the toner particles, the CV value of the toner particles is preferably 25 or less, more preferably 20 or less and even more preferably 18 or less.

Also, the toner preferably has a softening point of from 60 to 140° C., more preferably from 60 to 130° C. and even more preferably from 60 to 120° C. from the viewpoint of a good low-temperature fusing property. Further, the toner preferably has a glass transition point of from 30 to 80° C. and more preferably from 40 to 70° C. from the viewpoint of a good durability. In addition, the toner preferably has a maximum endothermic peak temperature as measured by a differential scanning calorimeter of from 60 to 140° C., more preferably from 60 to 130° C. and even more preferably from 60 to 120° C. from the same viewpoints.

In the present invention, an external additive such as a fluidizing agent may be added to the toner in order to treat the surface of the toner mother particles therewith. As the external additive, there may be used known fine particles. Examples of the fine particles include fine inorganic particles such as fine silica particles whose surface is subjected to a hydrophobic treatment, fine titanium oxide particles, fine alumina particles, fine cerium oxide particles, and carbon blacks; and fine polymer particles such as fine particles made of polycarbonates, polymethyl methacrylate, silicone resins, etc.

The amount of the external additive formulated is preferably from 1 to 5 parts by weight and more preferably from 1.5 to 3.5 parts by weight on the basis of 100 parts by weight of the toner mother particles before being treated with the external additive. Here, when a hydrophobic silica is used as the external additive, the hydrophobic silica is preferably added in an amount of from 1 to 3 parts by weight on the basis of 100 parts by weight of the toner mother particles before being treated with the external additive.

Examples of a transfer medium (recording medium) to which the toner for electrophotography according to the present invention is applicable include plain papers and OHP sheets used for electrophotographic copying machines and printers, etc.

The toner for electrophotography obtained according to the present invention may be used in the form of a one-component system developer or a tow-component system developer formed by mixing the toner with a carrier.

The present invention is described in more detail by referring to the following examples. However, it should be noted that these examples are only illustrative and not intended to limit the invention thereto.

Various properties were measured and evaluated by the following methods.

[Acid Value of Resins]

Determined according to JIS K0070. However, with respect to the solvent used upon the measurement, the mixed solvent of ethanol and ether was replaced with a mixed solvent containing acetone and toluene at a volume ratio of 1:1.

[Softening Point and Glass Transition Point of Resins and Toners]

(1) Softening Point

Using a flow tester "CFT-1500D" available from Shimadzu Seisakusho Co., Ltd., 1 g of a sample was extruded through a nozzle having a die pore diameter of 1 mm and a length of 1 mm while heating the sample at a temperature rise rate of 6° C./min and applying a load of 1.96 MPa thereto by a plunger. The softening point was determined as the temperature at which a half the amount of the sample was flowed out when plotting a downward movement of the plunger of the flow tester relative to the temperature.

(2) Glass Transition Point

Using a differential scanning calorimeter ("DSC 210" commercially available from Seiko Instruments, Inc.), a sample was heated to 200° C. and then cooled from 200° C. to 0° C. at a temperature drop rate of 10° C./min, and thereafter heated again at temperature rise rate of 10° C./min to measure a glass transition point thereof. When a peak was observed at a temperature lower by 20° C. or more than the softening point, the peak temperature was read as the glass transition point. Whereas, when a shift of the characteristic curve was observed without any peaks at the temperature lower by 20° C. or more than the softening point, the temperature at which a tangential line having a maximum inclination of the curve in the portion of the curve shift was intersected with an extension of the baseline on the high-temperature side of the curve shift was read as the glass transition point. Meanwhile, the glass transition point is a property inherent to an amorphous portion of the resin, which may be generally observed in an amorphous polyester, or may be also observed in an amorphous portion of a crystalline polyester in some cases.

[Weight-Average Molecular Weight of Resins and Emulsified Resin Particles]

The weight-average molecular weight Mw was calculated from the molecular weight distribution measured by gel permeation chromatography according to the following method. Meanwhile, the weight-average molecular weight of the emulsified resin particles was measured after drying the particles by a freeze-drying method.

(1) Preparation of Sample Solution

The resin binder or resin emulsion was dissolved in chloroform to prepare a solution having a concentration of 0.5 g/100 mL. The resultant solution was then filtered through a fluororesin filter ("FP-200" commercially available from Sumitomo Electric Industries, Ltd.) having a pore size of 2 μm to remove insoluble components therefrom, thereby obtaining a sample solution.

(2) Determination of Molecular Weight Distribution

Using the below-mentioned analyzer, chloroform was allowed to flow at a rate of 1 mL/min, and the column was stabilized in a thermostat at 40° C. One-hundred microliters of the sample solution was injected to the column to determine the molecular weight distribution. The molecular weight of the sample was calculated on the basis of a calibration curve previously prepared. The calibration curve of the molecular weight was prepared by using several kinds of monodisperse polystyrenes (those polystyrenes having molecular weights of $2.63\times10^3$, $2.06\times10^7$ and $1.02\times10^5$ available from Tosoh Corporation; and those polystyrenes having molecular weights of $2.10\times10^3$, $7.00\times10^3$ and $5.04\times10^4$ available from GL Science Co., Ltd.) as standard samples.

Analyzer: CO-8010, CCPE, AS-800 (commercially available from Tosoh Corporation)

Column: GMHLX+G3000HXL (commercially available from Tosoh Corporation)

[Particle Size and Particle Size Distribution of Emulsified Particles and Unified Particles]

(1) Measuring Apparatus: Laser diffraction particle size analyzer ("LA-920" commercially available from Horiba Seisakusho Co., Ltd.)

(2) Measuring Conditions: Using a cell for the measurement which was filled with distilled water, a volume median particle size ($D_{50}$) of the particles was measured at a temperature at which an absorbance thereof was within an adequate range. Further, the CV value was calculated according to the following formula:

$$CV\ \text{Value}=(\text{Standard Deviation of Particle Size Distribution/Volume Median Particle Size}(D_{50}))\times 100$$

[Particle Size of Toner]

Measuring Apparatus: Coulter Multisizer II (commercially available from Beckman Coulter Inc.)

Aperture Diameter: 50 μm

Analyzing Software: Coulter Multisizer AccuComp Ver. 1.19 (commercially available from Beckman Coulter Inc.)

Electrolyte Solution: "Isotone II" (commercially available from Beckman Coulter Inc.)

Dispersing Solution The dispersing solution was prepared by dissolving "EMULGEN 109P" (commercially available from Kao Corporation; polyoxyethylene lauryl ether; HLB: 13.6) in the above electrolyte solution such that the concentration of "EMULGEN 109P" in the obtained solution was 5% by weight.

Dispersing Conditions: Ten milligrams of a sample to be measured was added to 5 mL of the dispersing solution, and dispersed using an ultrasonic disperser for 1 min. Thereafter, 25 mL of the electrolyte solution was added to the dispersion, and the obtained mixture was further dispersed using the ultrasonic disperser for 1 min to prepare a sample dispersion.

Measuring Conditions: The thus prepared sample dispersion was added to 100 mL of the electrolyte solution, and after controlling a concentration of the resultant dispersion such that the determination for 30000 particles were completed at 20 s, the particle sizes of 30000 particles were measured under such a concentration condition, and a volume median particle size ($D_{50}$) thereof was determined from the particle size distribution. Further, the CV value is calculated according to the following formula:

$$CV\ \text{Value}=(\text{Standard Deviation of Particle Size Distribution/Volume Median Particle Size}(D_{50}))\times 100$$

PRODUCTION EXAMPLE 1

Production of Polyester A

A four-necked flask equipped with a nitrogen inlet tube, a dehydration tube, a stirrer and a thermocouple was charged with 32 g of polyoxypropylene(2.2)-2,2-bis(4-hydroxyphenyl)propane, 2896 g of polyoxyethylene(2.0)-2,2-bis(4-hydroxyphenyl)propane, 1524 g of terephthalic acid, 83 g of glycerol and 20 g of tin octylate as an esterification catalyst. The contents of the flask were reacted for 3.5 h under normal pressure (101.3 kPa) at 235° C. in a nitrogen atmosphere, thereby obtaining a polyester A.

PRODUCTION EXAMPLE 2

Production of Polyester B

The same procedure as in Production Example 1 was repeated except for using 2437 g of polyoxyethylene(2.0)-2,2-bis(4-hydroxyphenyl)propane, 1552 g of terephthalic acid, 138 g of glycerol and 21 g of tin octylate as an esterification catalyst, thereby obtaining a polyester B.

PRODUCTION EXAMPLE 3

Production of Polyester C

The same procedure as in Production Example 1 was repeated except for using 578 g of polyoxypropylene(2.2)-2,2-bis(4-hydroxyphenyl)propane, 2145 g of polyoxyethylene(2.0)-2,2-bis(4-hydroxyphenyl)propane, 1826 g of terephthalic acid, 253 g of glycerol and 20 g of tin octylate as an esterification catalyst, thereby obtaining a polyester C.

PRODUCTION EXAMPLE 4

Production of Polyester D

The same procedure as in Production Example 1 was repeated except for using 473 g of polyoxypropylene(2.2)-2,2-bis(4-hydroxyphenyl)propane, 1755 g of polyoxyethylene(2.0)-2,2-bis(4-hydroxyphenyl)propane, 1419 g of terephthalic acid, 164 g of sorbitol and 19 g of tin octylate as an esterification catalyst, and changing the reaction time to 5.5 h, thereby obtaining a polyester D.

PRODUCTION EXAMPLE 5

Production of Polyester E

Under a nitrogen atmosphere, 8320 g of polyoxypropylene(2.2)-2,2-bis(4-hydroxyphenyl)propane, 80 g of polyoxyethylene(2.0)-2,2-bis(4-hydroxyphenyl)propane, 1592 g of terephthalic acid and 32 g of dibutyl tin oxide as an esterification catalyst were reacted with each other under normal pressures at 230° C. for 5 h, and further reacted under reduced pressure (8 kPa). After the obtained reaction product was cooled to 210° C., 1672 g of fumaric acid and 8 g of hydroquinone were added thereto to conduct a reaction therebetween for 5 h, and further the reaction was conducted under reduced pressure, thereby obtaining a polyester E.

PRODUCTION EXAMPLE 6

Production of Polyester F

A four-necked flask equipped with a nitrogen inlet tube, a dehydration tube, a stirrer and a thermocouple was charged with 17500 g of polyoxypropylene(2.2)-2,2-bis(4-hydroxyphenyl)propane, 16250 g of polyoxyethylene(2.0)-2,2-bis(4-hydroxyphenyl)propane, 11454 g of terephthalic acid, 1608 g of dodecenyl succinic anhydride, 4800 g of trimellitic anhydride and 15 g of dibutyl tin oxide. The contents of the flask were reacted with each other at 220° C. under a nitrogen atmosphere while stirring until the softening point as measured according to ASTM D36-86 reached 120° C., thereby obtaining a polyester F.

PRODUCTION EXAMPLE 7

Production of Polyester G

A four-necked flask equipped with a nitrogen inlet tube, a dehydration tube, a stirrer and a thermocouple was charged with 2205 g of polyoxypropylene(2.2)-2,2-bis(4-hydroxyphenyl)propane, 878 g of polyoxyethylene(2.0)-2,2-bis(4-hydroxyphenyl)propane, 762 g of terephthalic acid, 941 g of dodecenyl succinic anhydride and 25 g of dibutyl tin oxide as an esterification catalyst. The contents of the flask were reacted with each other for 6 h at 235° C. under a normal pressure in a nitrogen atmosphere, and further reacted under reduced pressure for 3 h. Thereafter, 173 g of trimellitic anhydride was added to the obtained reaction product, and the mixture was reacted under normal pressures at 215° C. for 1 h, and further reacted under reduced pressure until the softening point as measured according to ASTM D36-86 reached 112° C., thereby obtaining a polyester G.

The respective polyesters A to G thus produced were subjected to measurements for various properties including a weight-average molecular weight, a softening point, a glass transition point and an acid value thereof as well as conditions of residue on a sieve when passing 1 kg of the resin through the sieve having an opening diameter of 5.6 mm as prescribed in JIS Z 8801. The results are shown together in Table 1.

TABLE 1

| | Production Examples | | | | | | |
|---|---|---|---|---|---|---|---|
| | 1 | 2 | 3 | 4 | 5 | 6 | 7 |
| Polyester | Polyester A | Polyester B | Polyester C | Polyester D | Polyester E | Polyester F | Polyester G |
| Weight-average molecular weight | $1.79 \times 10^4$ | $2.54 \times 10^4$ | $4.54 \times 10^4$ | $4.11 \times 10^4$ | $1.13 \times 10^4$ | $1.01 \times 10^5$ | $5.47 \times 10^4$ |
| Softening point (° C.) | 107 | 117 | 127 | 127 | 110 | 123 | 111 |
| Glass transition point (° C.) | 65 | 71 | 71 | 76 | 66 | 65 | 55 |
| Acid value (mg KOH/g) | 13.9 | 21.4 | 18.8 | 20.7 | 24.4 | 21 | 11.8 |
| Condition of residue on sieve | No residue | No residue | No residue | No residue | No residue | No residue | No residue |

EXAMPLE 1

Six-hundred grams of the polyester A, 30 g of a copper phthalocyanine pigment "ECB-301" available from Dai-Nichi Seika Kogyo Co., Ltd., 6 g of a nonionic surfactant "EMULGEN 430" (polyoxyethylene oleyl ether; HLB: 16.2) available from Kao Corporation, 40 g of an anionic surfactant "NEOPELEX G-15" (sodium dodecylbenzenesulfonate; concentration: 15% by weight) available from Kao Corporation, and 252 g of an aqueous potassium hydroxide solution (concentration: 5% by weight) as a neutralizing agent, were dispersed at 95° C. under normal pressure (101.3 kPa) in a 5 L stainless steel pot while stirring with a paddle-shaped stirrer at a rate of 250 r/min. After reaching 95° C., the contents of the pot were stirred for 2 h. Thereafter, while stirring the obtained mixture with a paddle-shaped stirrer at a rate of 200 r/min, 1118 g of deionized water was dropped into the mixture at a rate of 6 g/min. The obtained reaction mixture was passed through a wire mesh having a 200 mesh screen (opening: 105 μm) to obtain a resin emulsion 1 containing fine resin particles.

EXAMPLES 2 TO 4 AND COMPARATIVE EXAMPLES 1 AND 2

The same procedure as in Example 1 was repeated except that the polyesters shown in Table 2 were respectively used in place of the polyester A, thereby obtaining resin emulsions 2 to 6. Meanwhile, in Comparative Example 1, although deionized water was dropped into the reaction mixture, no emulsification thereof occurred.

REFERENCE PRODUCTION EXAMPLE 1

One hundred and five grams of the polyester F, 195 g of the polyester E, 3 g of a nonionic surfactant "EMULGEN 430" (polyoxyethylene lauryl ether (EO added: 30 mol); cloud point: 100° C. or higher; HLB:16.2) available from Kao Corp., 20 g of an anionic surfactant "NEOPELEX G-15" (sodium dodecylbenzenesulfonate; solid content: 15% by weight; water content: 85% by weight) available from Kao Corp., 15 g of a copper phthalocyanine pigment "ECB-301" available from Dai-Nichi Seika Kogyo Co., Ltd., and 138 g of an aqueous potassium hydroxide solution (concentration: 5% by weight, i.e., an amount required for neutralizing 100% of the polyester A) as a neutralizing agent, were dispersed at 95° C. in a 5 L stainless steel pot while stirring with a paddle-shaped stirrer at a rate of 200 r/min. After reaching 95° C., the contents of the pot were stirred for 2 h. Thereafter, while stirring the obtained mixture with a paddle-shaped stirrer at a rate of 200 r/min, 568 g of deionized water was dropped to the mixture at a rate of 3 g/min. The obtained reaction mixture was passed through a wire mesh having a 200 mesh screen (opening: 105 μm) to obtain a resin emulsion 7. It was confirmed that no residual resin component remained on the wire mesh, and the emulsified resin particles contained in the resin emulsion 7 had a particle size of 0.15 μm and a CV value of 26.

The polyesters used in the thus produced resin emulsions as well as various properties of the resin emulsions (including a volume median particle size ($D_{50}$) and a CV value of the emulsified resin particles, weigh-average molecular weights of the resin and the emulsified resin particles, a solid content and condition of residue on the vire mesh) are shown in Table 2.

Further, the respective resin emulsions were subjected to evaluation for hydrolysis resistance thereof. The results are shown in Table 2.

[Hydrolysis Resistance]

The weight-average molecular weights of the resin and the emulsified resin particles were measured to evaluate a resistance to hydrolysis thereof owing to an alkali upon producing the resin emulsions. More specifically, the weight-average molecular weight, $Mw_1$ of the resin used and the weight-average molecular weight $Mw_2$ of the emulsified resin particles were respectively measured by the above methods. The rate of change in hydrolysis was calculated from the rates of change in the respective weight-average molecular weights according to the following formula:

Rate of Change in Hydrolysis(%)=(weight-average molecular weight $Mw_2$ of the emulsified resin particles)/(weight-average molecular weight $Mw_1$ of the resin used)×100

Since 90% by weight or more of the solid component in the emulsified resin particles was constituted from the resin binder, the weight-average molecular weight $Mw_2$ of the emulsified resin particles was regarded as being substantially identical to the weight-average molecular weight of the resin binder contained in the emulsified resin particles. The hydrolysis resistance was evaluated according to the following evaluation criteria. The results are shown in Table 2.

Evaluation Criteria

A: The rate of change in hydrolysis was 90% or more; substantially no hydrolysis occurred;

B: The rate of change in hydrolysis was not less than 80% but less than 90%; slight hydrolysis occurred, but practically still acceptable;

C: The rate of change in hydrolysis was not less than 70% but less than 80%; hydrolysis occurred; and D: The rate of change in hydrolysis was less than 70%; considerable hydrolysis occurred, and practically unacceptable.

TABLE 2

| | Examples | | | |
|---|---|---|---|---|
| | 1 | 2 | 3 | 4 |
| Polyester[1)] | Polyester A: 100 parts | Polyester B: 100 parts | Polyester C: 35 parts Polyester E: 65 parts | Polyester D: 35 parts Polyester E: 65 parts |
| Polyhydric alcohol | Glycerol | Glycerol | Glycerol | Sorbitol |
| Content of polyhydric alcohol[2)] | 4.7 | 8.2 | 4.4 | 1.8 |
| Resin emulsion | 1 | 2 | 3 | 4 |
| Particle size of resin emulsion[3)] | 0.14 | 0.29 | 0.49 | 0.52 |
| CV value (%) | 26 | 24 | 41 | 43 |
| Solid content (wt %) | 30.0 | 28.7 | 29.4 | 29.4 |
| Condition of residue on wire mesh | No residue | No residue | No residue | Very small amount of residue |
| Weight-average molecular weight $Mw_1$ of resin | $1.79 \times 10^4$ | $2.54 \times 10^4$ | $2.30 \times 10^4$ | $2.29 \times 10^4$ |
| Weight-average molecular weight $Mw_2$ of emulsified resin particles | $1.71 \times 10^4$ | $2.05 \times 10^4$ | $2.25 \times 10^4$ | $1.82 \times 10^4$ |
| Rate of change in hydrolysis (%) | 96 | 81 | 98 | 80 |
| Hydrolysis resistance | A | B | A | B |

| | Comparative Examples | | Reference |
|---|---|---|---|
| | 1 | 2 | Example 1 |
| Polyester[1)] | Polyester F: 100 parts | Polyester G: 50 parts Polyester E: 50 parts | Polyester E: 65 parts Polyester F: 35 parts |
| Polyhydric alcohol | — | — | — |
| Content of polyhydric alcohol[2)] | — | — | — |
| Resin emulsion | 5 | 6 | 7 |
| Particle size of resin emulsion[3)] | Not emulsifiable | 0.61 | 0.15 |
| CV value (%) | — | 91 | 26 |
| Solid content (wt %) | — | 29.8 | 31.2 |
| Condition of residue on wire mesh | Large amount of residue | Very small amount of residue | No residue |
| Weight-average molecular weight $Mw_1$ of resin | — | $3.51 \times 10^4$ | $2.56 \times 10^4$ |
| Weight-average molecular weight $Mw_2$ of emulsified resin particles | — | $2.15 \times 10^4$ | $1.72 \times 10^4$ |
| Rate of change in hydrolysis (%) | — | 61 | 67 |
| Hydrolysis resistance | — | D | D |

Note:
1)Parts by weight on the basis of 100 parts by weight of whole resin components.
2)Mol % of polyhydric alcohol on the basis of whole constitutional monomers.
3)Volume median particle size ($D_{50}$) (μm) of emulsified particles contained in resin emulsion.

EXAMPLE 5

Four-hundred grams of the resin emulsion 1 was charged into a 2 L container, and mixed at room temperature. Next, an aqueous solution prepared by dissolving 6.30 g of ammonium sulfate (molecular weight: 132.14) as an aggregating agent in 104 g of deionized water (pH: 6.1; 0.25 mol/L) was dropped into the mixture at room temperature over 15 min. Thereafter, the resultant mixed dispersion was heated at a rate of 1° C./5 min to form aggregated particles. The dispersion was heated until reaching 85° C. at which the temperature was fixed, and the dispersion was stirred for 1.5 h, and then the heating was stopped.

The resultant dispersion was gradually cooled to room temperature, and then subjected to a suction filtration step, a washing step and a drying step to obtain fine colored resin particles (toner mother particles). The toner mother particles had a volume median particle size ($D_{50}$) of 4.5 μm.

Next, a hydrophobic silica ("TS530" commercially available from Wacker Chemie Corp.; number-average primary particle size: 8 nm) was externally added to the toner mother particles in an amount of 1.0 part by weight on the basis of 100 parts by weight of the toner mother particles by using a Henschel mixer to obtain a cyan toner. The obtained cyan toner was loaded to a commercially available full-color printer to form printed images. As a result, it was confirmed that the obtained printed images were good. Meanwhile, the cyan toner had a softening point of 102.5° C. and a glass transition point of 57.1° C.

EXAMPLES 6 TO 8 AND COMPARATIVE EXAMPLE 3

The same procedure as in Example 5 was repeated except that the resin emulsion was changed as shown in Table 3, thereby obtaining toners.

Various properties of the respective toners thus obtained (including a volume median particle size ($D_{50}$) of the toner mother particles, and a softening point and a glass transition point of the toner) are shown in Table 3.

EXAMPLE 9

Two-hundred grams of the resin emulsion 7 and 52 g of deionized water were charged into a 2 L container. Next, 253 g of a 0.45 mol/L ammonium sulfate aqueous solution was dropped into the container at room temperature over 30 min while stirring with a paddle-shaped stirrer at a rate of 100 r/min. Thereafter, the resultant dispersion was heated at a rate of 0.16° C./min while stirring to form aggregated particles. The dispersion was heated until reaching 57° C. at which the temperature was fixed, and then allowed to stand for 3 h, thereby obtaining aggregated particles.

While maintaining the temperature of the resultant aggregated particles at 57° C., a mixed solution composed of 208 g of the resin emulsion 1 and 54 g of deionized water was dropped thereinto at a rate of 1 g/min. Thirty minutes after completion of the dropping, a dilute solution prepared by diluting 4.2 g of a sodium polyoxyethylenedodecylethersulfate aqueous solution (solid content: 28% by weight) with 37 g of deionized water was added to the dispersion.

Thirty minutes after adding the dilute solution, the resultant dispersion was heated to 80° C. at a rate of 0.16° C./min and maintained at 80° C. for 1 h from the time at which the temperature of the dispersion reached 80° C., and then the heating was stopped.

The obtained dispersion was gradually cooled to room temperature, and then subjected to a suction filtration step, a washing step and a drying step to obtain toner mother particles.

Next, a hydrophobic silica ("TS530" commercially available from Wacker Chemie Corp.; number-average primary particle size: 8 nm) was externally added to the toner mother particles in an amount of 1.0 part by weight on the basis of 100 parts by weight of the toner mother particles using a Henschel mixer to obtain a cyan toner. The obtained toner had a volume median particle size ($D_{50}$) of 5.0 μm. The heat-resistant storage property of the obtained toner was evaluated by the above-mentioned method. The results are shown in Table 3.

The respective toners obtained above were subjected to evaluation for storage property thereof by the following methods. The results are shown in Table 3.

[Storage Property Test for Toners]

Ten grams of the toner was charged into a 20 mL non-sealed type container, and allowed to stand at 50° C. for 48 h. After the standing, the degree of aggregation of the toner was measured using a powder tester available from Hosokawa Micron Co., Ltd., to evaluate a storage property of the toner according to the following evaluation criteria. The results are shown in Table 3. Meanwhile, more specifically, the degree of aggregation of the toner was measured by the powder tester by the following method.

Three sieves which were different in mesh size from each other were set to an upper stage (250 μm), an intermediate stage (149 μm) and a lower stage (74 μm) on a vibrating table of the powder tester. Two grams of the toner was placed on the sieve of each stage, and vibration was applied to the respective sieves to measure a weight of the residual toner remaining on each sieve.

From the thus measured weights of the residual toner, the degree of aggregation of the toner was calculated according to the following formula:

$$\text{Degree of Aggregation}(\%)=a+b+c$$

wherein a=(weight of residual toner on an upper stage sieve)/2 (g)×100; b=(weight of residual toner on an intermediate stage sieve)/2 (g)×100×(3/5); and c=(weight of residual toner on a lower stage sieve)/2 (g)×100×(1/5).

Evaluation Criteria

A: The degree of aggregation was less than 10%; extremely good storage property;

B: The degree of aggregation was not less than 10% but less than 20%; good storage property; and C: The degree of aggregation was not less than 20%; poor storage property.

TABLE 3

| | Example 5 | Example 6 | Example 7 |
|---|---|---|---|
| Resin emulsion | Emulsion 1 | Emulsion 2 | Emulsion 3 |
| Volume median particle size of fine colored resin particles (μm) | 4.5 | 5.0 | 4.9 |
| Softening point (° C.) | 102.5 | 105.9 | 107.1 |
| Glass transition point (° C.) | 57.1 | 59.9 | 60.2 |
| Storage property of toner | A | B | A |

TABLE 3-continued

| | Example 8 | Example 9 | Comparative Example 3 |
|---|---|---|---|
| Resin emulsion | Emulsion 4 | Emulsions 7 and 1 | Emulsion 6 |
| Volume median particle size of fine colored resin particles (μm) | 5.1 | 5.0 | 5.3 |
| Softening point (° C.) | 103.1 | 102.7 | 104.7 |
| Glass transition point (° C.) | 59.7 | 53.4 | 53.1 |
| Storage property of toner | A | A | C |

What is claimed is:

1. A process for producing a toner for electrophotography, comprising:

(A) (A-1) obtaining a resin binder comprising an acid group-containing polyester having an acid value of 6 to 30 mg KOH/g produced from a raw monomer composition comprising a trivalent or higher-valent polyhydric alcohol in an amount of 1 to 15 mol % by polycondensing at a temperature of 180 to 250° C. by using an esterification catalyst, (A-2) dispersing the resin binder after adding a combination of an anionic surfactant and a nonionic surfactant to the resin binder, neutralizing the obtained dispersion with a basic compound in an aqueous medium; and thereafter, emulsifying the resin in the aqueous medium by adding an aqueous liquid to obtain a neutralized resin emulsion; and (B) aggregating and unifying emulsified resin particles contained in the obtained neutralized resin emulsion, wherein said neutralizing is conducted at a temperature not lower than a glass transition point but not higher than a softening point of the resin binder, and wherein said aqueous liquid is added to the neutralized dispersion at a temperature not lower than the glass transition point but not higher than the softening point of the resin binder to emulsify the resin in the aqueous medium.

2. The process according to claim 1, wherein the trivalent or higher-valent polyhydric alcohol is a trivalent to hexavalent aliphatic polyhydric alcohol.

3. The process according to claim 1, wherein the trivalent or higher-valent polyhydric alcohol is glycerol.

4. The process according to claim 1, wherein the resin binder dispersed in said (A-2) contains a colorant.

5. The process according to claim 1, wherein the trivalent or higher-valent polyhydric alcohol amount is 1.5 to 14 mol %.

6. The process according to claim 1, wherein the trivalent or higher-valent polyhydric alcohol amount is 1.5 to 13 mol %.

7. The process according to claim 1, wherein the trivalent or higher-valent polyhydric alcohol amount is 1.5 to 10 mol %.

8. The process according to claim 1, wherein said neutralizing is conducted at a temperature not lower than the glass transition point plus 10° C. but not higher than a softening point of the resin binder minus 5° C.

9. The process according to claim 1, wherein the resin binder containing acid group has an acid value of 7 to 28 mg KOH/g.

10. The process according to claim 1, wherein the resin binder containing acid group has an hydroxyl value of 3 to 60 mg KOH/g.

11. The process according to claim 1, wherein prior to neutralizing the resin binder, resin particles containing the resin binder are dispersed in an aqueous medium at a temperature lower than the softening point of the resin particles.

12. The process according to claim 1, wherein prior to neutralizing the resin binder, resin particles containing the resin binder are dispersed in an aqueous medium at a temperature lower than the softening point of the resin particles minus 50° C.

13. The process according to claim 1, wherein the acid group-containing polyester is amorphous.

14. The process according to claim 13, wherein the alcohol component of the polyester comprises alkyleneoxide adducts of bisphenol A represented by the formula (I):

(I)

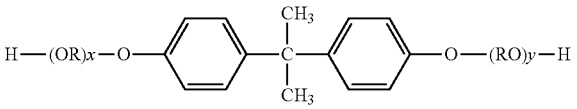

wherein RO is an alkyleneoxide; R is an alkylene group having 2 or 3 carbon atoms; and x and y respectively represent an average molar number of addition of alkylene oxides and are respectively a positive number with the proviso that a sum of x and y is from 1 to 16.

15. The process according to claim 1, wherein the content of the polyester in the resin binder is 90% by weight or larger.

16. The process according to claim 1, wherein the weight-average molecular weight of the polyester is from 10,000 to 120,000.

17. The process according to claim 1, wherein the weight-average molecular weight of the resin contained in the emulsified resin particles is from 10,000 to 120,000.

18. The process according to claim 1, wherein the water content in the aqueous medium is 100% by weight.

19. The process according to claim 1, wherein the amount of the surfactant added is 5% by weight or smaller, on the basis of the weight of the resin.

20. The process according to claim 1, wherein the amount of the surfactant added is from 0.2 to 5% by weight, on the basis of the weight of the resin.

* * * * *